US005772502A

United States Patent [19]

Smith

[11] Patent Number: 5,772,502

[45] Date of Patent: Jun. 30, 1998

[54] ADJUSTABLE PITCH ROOF VENT WITH ACCORDION-SHAPED END PLUG

[75] Inventor: Joe E. Smith, Jacksonville, Ark.

[73] Assignee: Lomanco, Inc., Jacksonville, Ark.

[21] Appl. No.: 898,922

[22] Filed: Jul. 23, 1997

[51] Int. Cl.[6] ..... F24F 7/02

[52] U.S. Cl. ..... 454/365; 52/95; 52/199

[58] Field of Search ..... 454/365, 260; 52/94, 95, 199

[56] References Cited

U.S. PATENT DOCUMENTS

| | | | |
|---|---|---|---|
| 1,028,725 | 6/1912 | Hodgson . | |
| 1,717,728 | 6/1929 | Moore . | |
| 2,049,863 | 8/1936 | Palmer | 189/1 |
| 2,214,183 | 9/1940 | Seymour | 108/8 |
| 2,388,759 | 11/1945 | Moore | 98/42 |
| 2,799,214 | 7/1957 | Roose | 98/42 |
| 2,868,104 | 1/1959 | Honholt et al. | 98/42 |
| 2,988,980 | 6/1961 | Tschudin | 98/40 |
| 3,185,070 | 5/1965 | Smith | 98/42 |
| 3,236,170 | 2/1966 | Meyer et al. | 98/42 |
| 3,241,474 | 3/1966 | Rousey et al. | 98/42 |
| 3,303,773 | 2/1967 | Smith et al. | 98/42 |
| 3,326,113 | 6/1967 | Smith et al. | 98/42 |
| 3,481,263 | 12/1969 | Belden | 98/42 |
| 3,625,134 | 12/1971 | Smith | 98/42 |
| 3,660,955 | 5/1972 | Simon | 52/420 |
| 3,949,657 | 4/1976 | Sells | 98/42 |
| 4,073,106 | 2/1978 | Malott | 52/199 |
| 4,090,435 | 5/1978 | Vallee | 98/42 |
| 4,252,590 | 2/1981 | Rasen et al. | 156/167 |
| 4,280,399 | 7/1981 | Cunning | 98/42 |
| 4,325,290 | 4/1982 | Wolfert | 98/42 |
| 4,342,807 | 8/1982 | Rasen et al. | 428/180 |
| 4,554,862 | 11/1985 | Wolfert | 98/42.21 |
| 4,643,080 | 2/1987 | Trostle et al. | 98/42.21 |
| 4,676,147 | 6/1987 | Mankowski | 98/42.21 |
| 4,782,743 | 11/1988 | Quinnell | 98/42.21 |
| 4,817,506 | 4/1989 | Cashman | 98/42.21 |
| 4,843,953 | 7/1989 | Sells | 98/42.21 |
| 4,903,445 | 2/1990 | Mankowski | 52/199 |
| 4,924,761 | 5/1990 | MacLeod et al. | 98/42.21 |
| 4,957,037 | 9/1990 | Tubbesing et al. | 98/42.21 |
| 5,009,149 | 4/1991 | MacLeod et al. | 98/42.21 |
| 5,070,771 | 12/1991 | Mankowski | 454/275 |
| 5,095,810 | 3/1992 | Robinson | 454/365 |
| 5,112,278 | 5/1992 | Roberts | 98/365 |
| 5,122,095 | 6/1992 | Wolfert | 454/365 |
| 5,149,301 | 9/1992 | Gates | 454/365 |
| 5,167,579 | 12/1992 | Rotter | 454/365 |
| 5,288,269 | 2/1994 | Hanson | 454/365 |
| 5,458,538 | 10/1995 | MacLeod et al. | 454/365 |

*Primary Examiner*—Harold Joyce
*Assistant Examiner*—Derek S. Boles
*Attorney, Agent, or Firm*—Walker, McKenzie & Walker, P.C.

[57] ABSTRACT

An adjustable-pitch ridge vent having accordion-shaped pleated end plugs for covering an opening at the peak of a roof. The ridge vent has a top panel having opposed lateral edges and having opposed ends, and has a flexible midsection parallel to the opposed lateral edges. A plurality of semi-circular supports extending downwardly from the underside of the top panel suspend the top panel above the roof. Lateral sidewall portions, which downwardly depend from the lateral edges of the vent, have louvered ventilation openings for allowing air to escape out of the opening at the roof's peak and pass from under the vent. Gutters with outwardly upturned lips and with drain openings are adjacent the ventilation openings. Coacting male and female joiners, respectively at the ends of the vent, sealingly join adjacent like ridge vents to each other. The endwalls of the vent each have a flexible accordion-pleated midportion end plug formed therein, and the ratio of the total pleat length to the pleated midportion length is preferably at least 1.5. Shingles are nailed atop the vent after the vent is nailed to the roof, with the vent straddling the opening at the apex of the roof.

9 Claims, 3 Drawing Sheets

ADJUSTABLE PITCH ROOF VENT WITH ACCORDION-SHAPED END PLUG

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

The present invention relates, in general, to roof vents and, in particular, to adjustable pitch "shingle-over" roof vents and end plugs therefor.

2. Information Disclosure Statement

It is often necessary or desirable in constructing buildings to provide for ventilation of attic space or other building space under sloped roofs. Well-known solutions include so-called "shingle-over roof vents" such as that described in Robinson, U.S. Pat. No. 5,095,810, issued Mar. 17, 1992, and fully incorporated by reference herein, as well as that described in Wolfert, U.S. Pat. No. 5,122,095, issued Jun. 16, 1992, and fully incorporated by reference herein. A plurality of such shingle-over roof vents are installed end-to-end longitudinally overlying the open ridge at the apex of a sloped roof, with well-known shingles, typically asphalt shingles, affixed over the top surface of the roof vent. At the ends of the roof, the endmost shingle-over roof vents typically have the gap between the roof vent and the roof plugged with filter material as taught in the Wolfert patent or with foam material as taught in the Robinson patent, so as to prevent the entry of weather, wind, insects, birds, and the like. A disadvantage of the prior art is that these foam or filter material plugs can become lost at the construction site.

Another problem faced by the prior art is that not all roofs are similarly sloped, and the differences in roof slope pitches necessitates that the shingle-over ridge vents be longitudinally flexible along the apex of the roof so as to conform to the slop of the particular roof. Such required flexibility heretofore precluded the use of end plugs integrally molded into the shingle-over ridge vents of the prior art. Prior art end plug solutions to this requirement of flexibility of the roof vent include MacLeod et al., U.S. Pat. No. 5,009,149, issued Apr. 23, 1991, and fully incorporated herein by reference, as well as MacLeod et al., U.S. Pat. No. 5,548,538, issued Oct. 17, 1995, and fully incorporated herein by reference. These MacLeod patents teach the use of overlapping adjacent downwardly-depending tabs or wall members at the ends of the shingle-over ridge vents that slidably overlap one another as the ridge vent flexibly bends over the apex of the roof, so as to plug the exposed ends of the ridge vents. A problem with such a slidably overlapping construction for the end plugs is that a continuous seal is not formed at the ends of the roof vents, thereby causing gaps or slots to exist in the end walls of the roof vents through which insects, bugs, and the like may enter.

It is therefore desirable to have an adjustable pitch shingle-over ridge vent whose ends are integral with the vent and continuously sealed without the use of separate plugs or filter material, and without having gaps, slots, or holes therethrough.

None of these references, either singly or in combination, disclose or suggest the present invention.

BRIEF SUMMARY OF THE INVENTION

The present invention is a "shingle-over" ridge vent for covering an opening at a peak of a roof, wherein the ridge vent has endwall portions at opposite ends of the ridge vent with a plurality of flexible accordion pleats in the endwall portions that act as flexing end plugs for the ridge vent while allowing the ridge vent to flex along a centrally longitudinal region to accommodate varying roof pitches. The accordion pleats are sealed to each other, to the top panel of the roof vent, and to the endwall portion without gaps or slidably overlapping tabs.

It is an object of the present invention to provide an adjustable pitch shingle-over ridge vent whose endwalls are continuous and integral with the vent and sealed without the use of separate plugs or filter material. It is a further object of the present invention that the endwalls of the ridge vent be without gaps, slots, or holes therethrough.

DETAILED DESCRIPTION OF THE INVENTION

Figure 1:
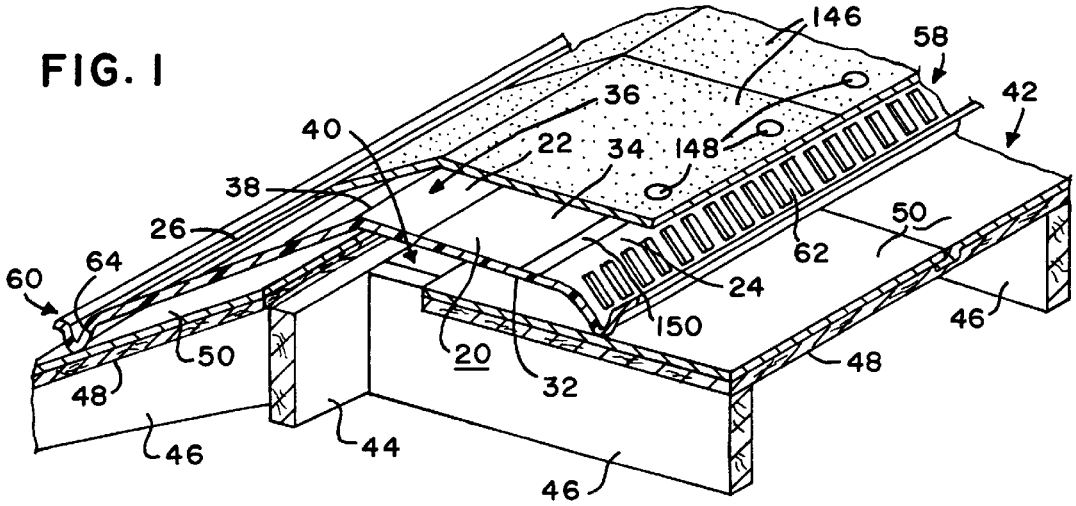
FIG. 1 is a perspective sectional view of the present invention installed at the apex of a roof, with portions of the invention and shingles thereover shown partially removed for clarity.
Figure 2:
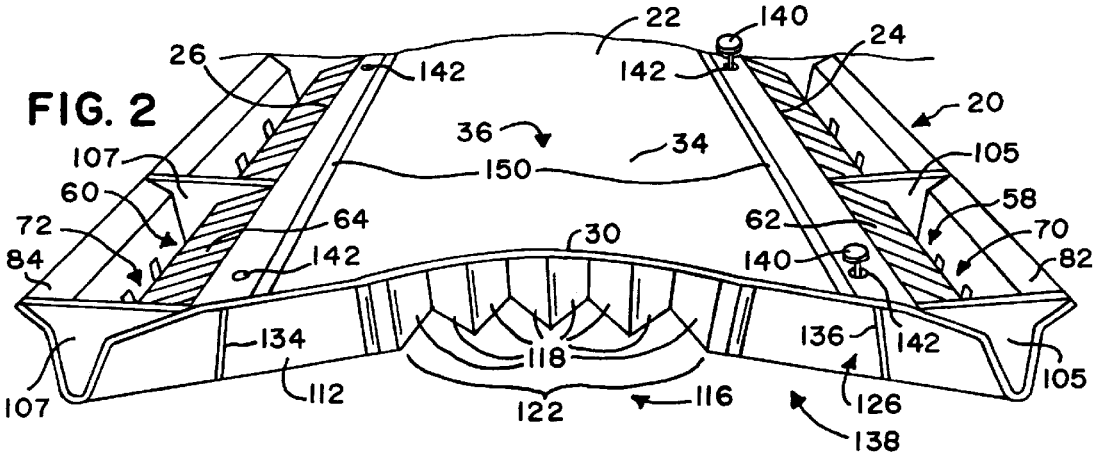
FIG. 2 is a first partial perspective end view of the present invention with some perspective exaggeration for clarity.
Figure 3:
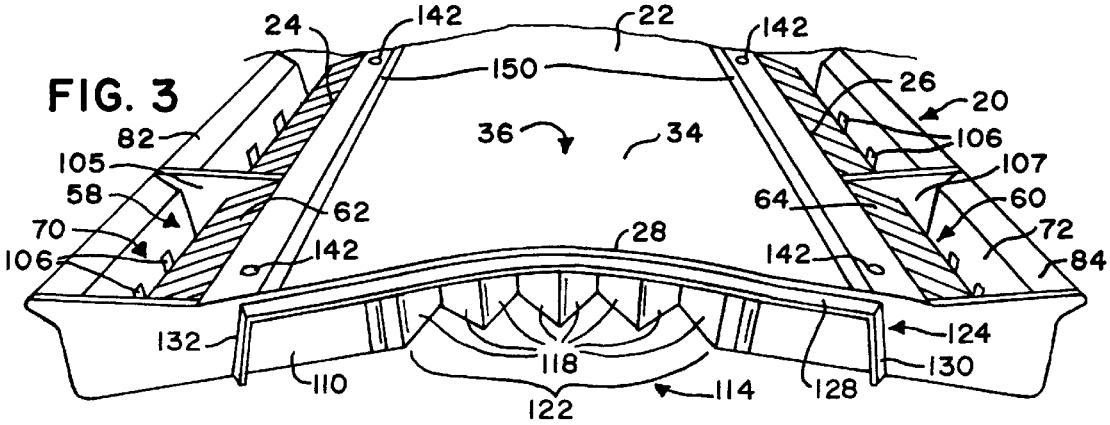
FIG. 3 is a second partial perspective end view of the present invention with some perspective exaggeration for clarity.

Referring to FIGS. 1–6, the adjustable pitch roof vent 20 of the present invention, a so-called "shingle-over ridge vent" or "SOV", is seen to comprise a top panel portion 22 having first 24 and second 26 opposed lateral edges and having first 28 and second 30 opposed ends. The top panel portion 22 has an underside 32 and a topside 34 and further has a midsection 36 substantially parallel to the first and second lateral edges 24 and 26, with midsection 36 preferably being flexible within a centrally longitudinal region 38 substantially parallel to first and second lateral edges 24 and 26. In the preferred embodiment, roof vent 20 is moldedly formed as a single piece from flexible plastic, preferably a plastic such as a polypropylene copolymer, and the flexible longitudinal region 38 of midsection 36 is somewhat thinner in thickness than the rest of top panel portion 22 so as to allow longitudinal flexing of midsection 36 over the apex of the roof 42 to accommodate varying roof pitches. Each roof vent 20 is preferably approximately 4 feet (122 cm.) in length, with FIGS. 2 and 3 showing approximately a one foot (30 cm.) length of each opposite end of roof vent 20.

Roof vent 20 is adapted for covering a well-known opening 40 at the peak or apex of a roof 42. In a manner well-known to those skilled in the art, roof 42 is formed with a longitudinal main beam 44 supported by a plurality of transverse cross-beams such as cross-beams 46, and cross beams 46 support well-known plywood decking panels 48 thereover, with decking panels 48 being covered by a plurality of shingles 50 and roofing paper (not shown) affixed to decking panels 48 as by nails or the like, in a manner well-known to those skilled in the art. Shingles 50 and decking panels 48 stop short of main beam 44 so as to form a gap or opening 40 adjacent main beam 44 and on either side thereof at the peak or apex of roof 42, in a manner well-known to those skilled in the art.

Figure 4:
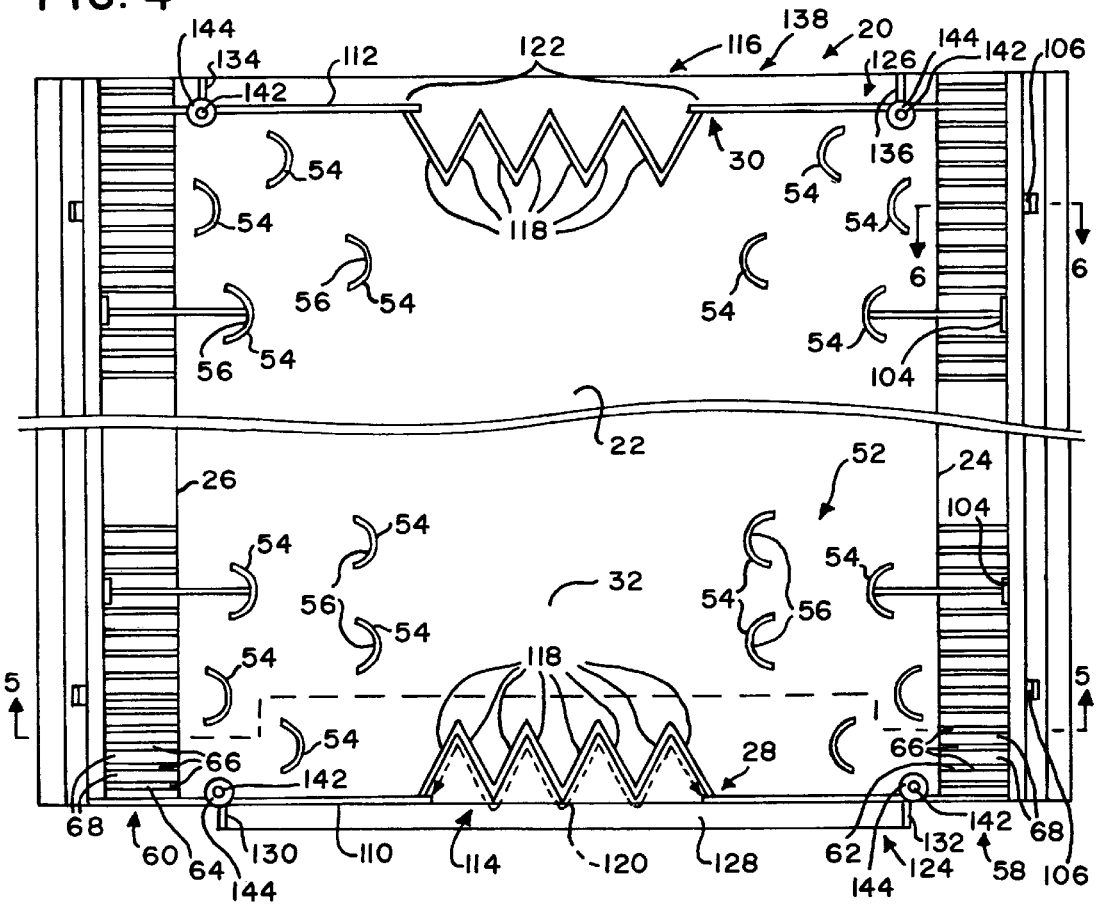
FIG. 4 is a bottom plan view of two portions of the invention.

Roof vent 20 includes support means 52 for supporting top panel portion 22 above roof 42, with support means 52 preferably comprising a plurality of support members 54 depending downwardly from the underside 32 of top panel portion 22 as shown. Support members 54 are preferably staggered in a non-sinusoidal manner along the underside 32 of top panel portion 22, as best seen in FIG. 4, so as to allow air to flow between the support members 54, with support members 54 preferably being semicircular in cross-section and having the concave portion 56 of each support member 54 opening toward the closest lateral edge (24 or 26, as appropriate) so as to impede the entry of snow or debris past support members 54 into opening 40. Additionally, support members 54 together preferably span the respective lateral edges 24 and 26, with one support member 54 spanning one portion and another support member 54 spanning another portion, so as to further impede the entry of snow or debris past support members 54 into opening 40.

Roof vent 20 further includes first 58 and second 60 ventilation means for allowing air to escape from within the building's attic, out the opening 40, and then to pass from under the roof vent 20 and out, with first and second ventilation means 58 and 60 preferably being substantially mirror images of each other and being respectively disposed adjacent first and second lateral edges 24 and 26. Preferably, roof vent 20 includes first 62 and second 64 lateral sidewall portions respectively downwardly depending from first 24 and second 26 lateral edges, and first 58 and second 60 ventilation means each include a plurality of spaced ribs 66 formed respectively within first 62 and second 64 lateral sidewall portions, with each respective plurality of spaced ribs 66 defining louvered ventilation openings 68 therebetween of ventilation means 58, 60. Adjacent lateral sidewall portions 62, 64 respectively are gutters 70, 72 extending downwardly for resting upon the roof 42 and opening upwardly for receipt of water, with gutters 70, 72 being joined to the respective sidewall portions 62, 64 along inner edges 74, 76 respectively. The outer edges 78, 80 of the gutters 70, 72 preferably have outwardly upturned lips 82, 84, and each gutter preferably has a plurality of inner wall drain openings 104 and outer wall drain openings 106.

As outside air rises and moves up the roof 42 toward the roof's peak, it is deflected by the outer edges 78, 80 of the gutters 70, 72 and outwardly upturned lips 82, 84 so as to create a region of low air pressure adjacent louvered openings 68 that draws air through louvered openings 68 of ventilation means 58, 60 from underneath the roof vent 20, thereby causing air to be drawn out of the building's attic and out of opening 40, thereby cooling and ventilating the attic. When air is blowing parallel to the roof's ridge at the top of the building, i.e., longitudinally along the roof vent, spaced baffles 105, 107 within the gutters 70, 72 similarly act to deflect the air and create a low air pressure region behind the baffles 105, 107 that similarly draws air out of the building's attic through the louvered openings 68 of ventilation means 58, 60.

Figure 6:
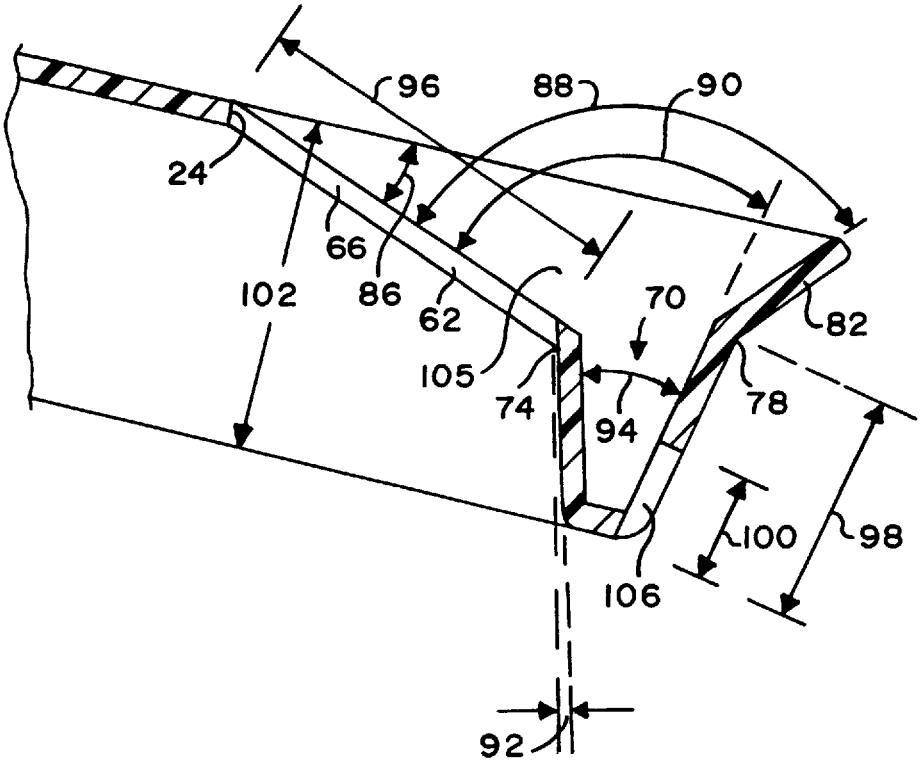
FIG. 6 is a partial transverse sectional view of the gutter of the invention, taken substantially along the line 6—6 shown in FIG. 4.

Table 1 shows the various preferred dimensions and angles for roof vent 20 as shown in FIG. 6.

TABLE 1

| Ref. Num. | Description | Measurement |
|---|---|---|
| 86 | lateral sidewall angle down from top panel | 21 degrees |
| 88 | gutter lip angle to lateral sidewall | 118 degrees |
| 90 | outer gutter wall angle to lateral sidewall | 79 degrees |
| 92 | inner gutter wall angle from vertical | 1 degree |
| 94 | gutter opening angle between gutter walls | 55 degrees |
| 96 | ventilation opening length | 1.25 inches (3.175 cm) |
| 98 | outer gutter wall height | 0.6942 inches (1.76 cm) |
| 100 | gutter drain opening height | 0.3156 inches (0.80 cm) |
| 102 | top panel height above roof | 1.08 inches (2.74 cm) |

Figure 5:
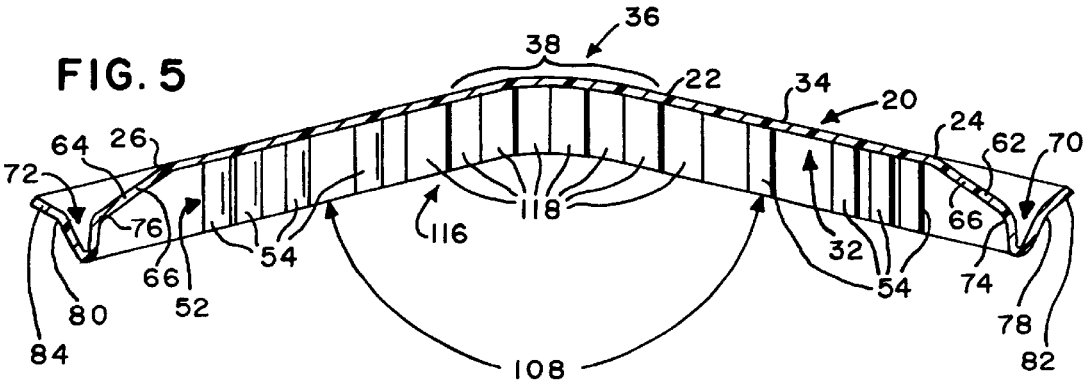
FIG. 5 is a partial transverse sectional view of the invention, taken substantially along the line 5—5 shown in FIG. 4, with portions removed for clarity.

As shown in FIG. 5, roof vent 20 preferably is pre-molded for a nominal roof apex angle 108 of 152 degrees corresponding to a run/rise ratio of the roof pitch of approximately 12/3 corresponding to a roof pitch of approximately 14 degrees, but the flexible longitudinal region 38 of midsection 36 allows roof vent 20 to flex to greater or lesser angles to accommodate roof pitches of greater or lesser amounts, with roof vent 20 preferably being flexibly adjustable to fit roof pitches having run/rise ratios of 12/12 to 16/12.

Referring to FIGS. 2–5, the accordion-shaped end plugs of the present invention can now be described.

Each roof vent 20 includes a first 110 and preferably a second 112 endwall portion respectively disposed adjacent the first and second opposed ends 28 and 30, with the top of endwall portions 110 and 112 being respectively sealingly joined to the underside 32 of top panel portion 22 and extending downwardly therefrom. Each endwall portion 110, 112 respectively includes a flexible pleated midportion 114, 116 adjacent the midsection 36 of top panel portion 22, and each pleated midportion 114, 116 includes a plurality of adjacent pleats 118 sealingly joined in sequence to each other and to the midsection 36 of top panel portion 22. As midsection 36 flexes along the longitudinal region of flex 28, pleats 118 act as an accordion to flex and allow the roof vent 20 to accommodate varying roof pitches while still maintaining a seal to top panel portion 22 and without having any gaps, slots, or holes through endwall portions 110, 112.

The pleated midportions 114, 116 each have a total pleat length 120, defined as the sum of the pleat lengths of each of the pleats 118, and total pleat length 120 is preferably approximately 9.77 inches (24.8 cm.) total for the eight pleats shown. Additionally, the pleated midportions 114, 116 each have a midportion length 122, defined as the nominal transverse span of each midportion 114 or 116 spanned by the accordion pleats 118, preferably having a span of approximately 4.4 inches (11.2 cm.) for midportion length 122 as shown, and the ratio of the total pleat length 120 divided by the midportion length 122 is preferably at least 1.5 so as to provide sufficient flexibility in the pleated midportion to accommodate flexing of roof vent 20 over roof apexes of varying pitch. Although eight pleats are shown in each pleated midportion 114, 115 in the preferred embodiment, it will be understood that the number of pleats may be greater or lesser, as desired providing that the required flexibility of the accordion-pleated midportion is maintained.

Endwall portions 110, 112 of roof vent 20 respectively further preferably include first 124 and second 126 coacting joining means for joining to respective like second 126 and first 124 coacting joining means of another like roof vent 20.

First coacting joining means 124 preferably includes a top male lip 128 and first 130 and second 132 side male lips, with top male lip 128 and first and second male lips 130, 132 extending outwardly from first endwall portion 110 and sealingly joined thereto, and with first male lip 130 and second male lip 132 also being sealingly joined to top male lip 128 so as to create a continuous sealed male barrier extending outwardly from first endwall portion 110.

Second coacting joining means 126 preferably includes first 134 and second 136 walls downwardly depending from top panel portion 22 and extending outwardly from second endwall portion 112 so as to form female receptacle means 138 of second endwall portion 112 for closely and sealingly receiving the first coacting joining means 124 of another like roof vent 20, with first wall 134 closely and abuttingly receiving first male lip 130, with second wall 136 closely and abuttingly receiving second male lip 132, and with the underside of the end of top panel portion 22 closely receiving top male lip 128 of the another like roof vent 20.

Referring to FIGS. 1–4, to use the ridge vent 20 of the present invention, a roof 42 is first constructed in a manner well-known to those skilled in the art, with a main beam 44 being supported by cross-beams 46 and with decking panels 48 being covered by roofing paper (not shown) and shingles 50, with shingles 50 typically being made of asphalt and being nailed to decking panels 48 using well-known roofing nails (not shown).

Next, a plurality of ridge vents 20 are placed end-to-end along the apex of the roof 42, with the first coacting joining means 124 of one ridge vent 20 being interlockingly joined with the second coacting joining means 126 of another like ridge vent 20 so as to sealingly join the top panel portion 22 of one ridge vent 20 to the top panel portion 22 of the adjacent ridge vent 20. A plurality of anchoring nails 140 are respectively inserted through the bores 142 through molded guides 144 and then anchoring nails 140 are pounded into decking panels 48 using a hammer or the like, so as to secure each ridge vent 20 to roof 42. Finally, a plurality of shingles 146 are placed atop the joined sequence of ridge vents 20 and roofing nails 148 are inserted through shingles 146 along the nail lines 150 that are molded into the topside 34 of each ridge vent 20, thereby securing the shingles 146 to the ridge vents 20 for diversion of water thereover and into gutters 70 and 72.

Thus joined, the plurality of ridge vents 20 will have exposed accordion pleated end plugs at either end of the roof, thereby sealing the ends of the ridge vents from entry of insects, debris, snow, etc. under the ridge vents and into the opening 40 at the apex of the roof. It will be understood that additional pleated end plugs of adjacent similar ridge vents 20 will be in proximity to each other along the apex of the roof 42 at each joining of first and second coacting joining means 124 and 126, in a manner hereinbefore described.

Although the present invention has been described and illustrated with respect to a preferred embodiment and a preferred use therefor, it is not to be so limited since modifications and changes can be made therein which are within the full intended scope of the invention.

I claim:

1. A ridge vent for covering an opening at a peak of a roof, said ridge vent comprising:

(a) a top panel portion having first and second opposed lateral edges and having first and second opposed ends; said top panel portion having an underside and further having a midsection substantially parallel to said first and second opposed lateral edges;

(b) support means for supporting said top panel portion above the roof, said support means comprising a plurality of support members depending downwardly from said underside of said top panel portion;

(c) first and second ventilation means respectively disposed adjacent said first and second opposed lateral edges;

(d) an endwall portion respectively disposed adjacent said first opposed end and sealingly joined thereto and extending downwardly from said first opposed end, said endwall portion having a pleated midportion adjacent to said midsection of said top panel portion; said pleated midportion of said endwall portion comprising a plurality of adjacent pleats sealingly joined in sequence to each other and to said midsection of said top panel portion.

2. The ridge vent as recited in claim 1, in which said plurality of adjacent pleats of said pleated midportion of said endwall portion has a total pleat length and said pleated midportion of said endwall portion has a midportion length, and said total pleat length divided by said midportion length is a ratio of at least 1.5.

3. A ridge vent for covering an opening at a peak of a roof, said ridge vent comprising:

(a) a top panel portion having first and second opposed lateral edges and having first and second opposed ends; said top panel portion having an underside and further having a midsection substantially parallel to said first and second opposed lateral edges;

(b) support means for supporting said top panel portion above the roof, said support means comprising a plurality of support members depending downwardly from said underside of said top panel portion;

(c) first and second ventilation means respectively disposed adjacent said first and second opposed lateral edges;

(d) first and second endwall portions respectively disposed adjacent said first and second opposed ends and respectively sealingly joined thereto and respectively extending downwardly from said first and second opposed ends, each said endwall portion having a pleated midportion adjacent to said midsection of said top panel portion; each said pleated midportion of each said endwall portion comprising a plurality of adjacent pleats sealingly joined in sequence to each other and to said midsection of said top panel portion.

4. The ridge vent as recited in claim 3, in which said plurality of adjacent pleats of each said pleated midportion of each said endwall portion has a total pleat length and said pleated midportion of each said endwall portion has a midportion length, and said total pleat length divided by said midportion length is a ratio of at least 1.5.

5. The ridge vent as recited in claim 3, in which said first and said second endwall portions respectively include first and second coacting joining means for joining to respective like second and first coacting joining means of another like ridge vent.

6. The ridge vent as recited in claim 5, in which:

said first coacting joining means includes a top male lip and first and second side male lips; said top male lip and said first and second side male lips extending outwardly from said first endwall portion and sealingly joined thereto; said first and second side male lips being sealingly joined to said top male lip; and said second coacting joining means includes first and second walls downwardly-depending from said top panel portion so as to form female receptacle means of said second endwall portion for sealingly receiving said like first coacting joining means of said another like ridge vent.

7. The ridge vent as recited in claim 3, in which said midsection of said top panel portion is flexible along a region substantially parallel to said first and second opposed lateral edges.

8. A ridge vent for covering an opening at a peak of a roof, said ridge vent comprising:

(a) a top panel portion having first and second opposed lateral edges and having first and second opposed ends; said top panel portion having an underside and further having a midsection substantially parallel to said first and second opposed lateral edges;

(b) support means for supporting said top panel portion above the roof, said support means comprising a plurality of support members depending downwardly from said underside of said top panel portion;

(c) first and second ventilation means respectively disposed adjacent said first and second opposed lateral edges;

(d) first and second endwall portions respectively disposed adjacent said first and second opposed ends and respectively sealingly joined thereto and respectively extending downwardly from said first and second opposed ends, each said endwall portion having a pleated midportion adjacent to said midsection of said top panel portion; each said pleated midportion of each said endwall portion comprising a plurality of adjacent pleats sealingly joined in sequence to each other and to said midsection of said top panel portion; said plurality of adjacent pleats of each said pleated midportion of each said endwall portion having a total pleat length and said pleated midportion of each said endwall portion having a midportion length, and said total pleat length divided by said midportion length being a ratio of at least 1.5; said first and said second endwall portions respectively including first and second coacting joining means for joining to respective like second and first coacting joining means of another like ridge vent; said first coacting joining means includes a top male lip and first and second side male lips; said top male lip and said first and second side male lips extending outwardly from said first endwall portion and sealingly joined thereto; said first and second side male lips being sealingly joined to said top male lip; and said second coacting joining means including first and second walls downwardly-depending from said top panel portion so as to form female receptacle means of said second endwall portion for sealingly receiving said like first coacting joining means of said another like ridge vent.

9. The ridge vent as recited in claim 8, in which said ridge vent includes first and second lateral sidewall portions respectively downwardly depending from said first and second opposed lateral edges, and said first and second ventilation means each include a plurality of spaced ribs formed respectively within said first and second lateral sidewall portions, each said respective plurality of spaced ribs defining ventilation openings therebetween.

* * * * *